US010945529B2

(12) United States Patent
O'Boyle et al.

(10) Patent No.: US 10,945,529 B2
(45) Date of Patent: Mar. 16, 2021

(54) CHAIR

(71) Applicant: ZHEJIANG SUNON FURNITURE MANUFACTURE CO., LTD., Zhejiang (CN)

(72) Inventors: Ruarc O'Boyle, Nuremberg (DE); Peter Horn, Dresden (DE)

(73) Assignee: ZHEJIANG SUNON FURNITURE MANUFACTURE CO., LTD., Zhejiang (CN)

( * ) Notice: Subject to any disclaimer, the term of this patent is extended or adjusted under 35 U.S.C. 154(b) by 0 days.

(21) Appl. No.: 16/483,453

(22) PCT Filed: Feb. 5, 2018

(86) PCT No.: PCT/EP2018/052821
§ 371 (c)(1),
(2) Date: Aug. 5, 2019

(87) PCT Pub. No.: WO2018/141968
PCT Pub. Date: Aug. 9, 2018

(65) Prior Publication Data

US 2020/0029695 A1 Jan. 30, 2020

(30) Foreign Application Priority Data

Feb. 3, 2017 (DE) ..... 10 2017 102 148.5

(51) Int. Cl.
*A47C 1/032* (2006.01)
*A47C 1/035* (2006.01)
*A47C 7/44* (2006.01)

(52) U.S. Cl.
CPC ..... *A47C 7/44* (2013.01); *A47C 1/035* (2013.01); *A47C 1/03279* (2018.08); *A47C 7/444* (2018.08); *A47C 7/4454* (2018.08)

(58) Field of Classification Search
CPC ..... A47C 7/44; A47C 1/03279; A47C 7/444; A47C 7/445; A47C 7/4454
USPC ..... 297/285–301.7
See application file for complete search history.

(56) References Cited

U.S. PATENT DOCUMENTS 148,380 A * 3/1874 Perrenet ..... A47C 1/032 297/354.1
3,552,797 A * 1/1971 D'Houdain ..... A61G 15/10 297/354.1
4,377,308 A * 3/1983 Pisanu ..... A47C 3/14 297/353
5,022,709 A 6/1991 Marchino
(Continued)

FOREIGN PATENT DOCUMENTS

DE 102011001811 A1 10/2012
DE 102011104972 A1 12/2012
DE 102012107778 A1 6/2014

OTHER PUBLICATIONS

International Search Report (and English translation) and Written Opinion of the International Searching Authority for PCT/EP2018/052821 dated Apr. 25, 2018.

*Primary Examiner* — Rodney B White
(74) *Attorney, Agent, or Firm* — Heslin Rothenberg Farley and Mesiti PC; Nicholas Mesiti

(57) ABSTRACT

A chair includes a seat surface and a laterally pivotable backrest. The backrest is secured to two joints, which have mutually parallel axes of rotation.

11 Claims, 10 Drawing Sheets

(56) References Cited

U.S. PATENT DOCUMENTS 5,951,109 A * 9/1999 Roslund, Jr. ..... A47C 1/03255 297/299
6,059,363 A * 5/2000 Roslund, Jr. ..... A47C 1/03255 297/301.4
6,116,687 A * 9/2000 Vogtherr ..... A47C 7/448 297/291
6,523,895 B1 * 2/2003 Vogtherr ..... A47C 1/024 297/291
7,416,251 B2 * 8/2008 Chu ..... A47C 7/448 297/285
7,434,879 B2 * 10/2008 Ueda ..... F16F 1/22 297/296
7,637,570 B2 * 12/2009 Becker ..... A47C 1/03238 297/314
7,665,805 B2 * 2/2010 Ueda ..... A47C 1/03261 297/301.6
7,712,833 B2 * 5/2010 Ueda ..... A47C 1/03255 297/296
7,717,513 B2 * 5/2010 Ueda ..... A47C 7/443 297/300.2
7,857,389 B2 * 12/2010 Ueda ..... A47C 1/03255 297/296
7,862,120 B2 * 1/2011 Ueda ..... A47C 1/03261 297/297
9,079,514 B2 * 7/2015 Haller ..... B60N 2/2222
9,504,325 B2 * 11/2016 Sander ..... A47C 7/54
9,504,330 B2 * 11/2016 Gehner ..... A47C 1/03255
9,713,380 B2 * 7/2017 Gehner ..... A47C 5/00
9,718,384 B2 * 8/2017 Haller ..... B60N 2/986
9,827,881 B2 * 11/2017 Haller ..... B60N 2/643
10,058,180 B2 * 8/2018 Desanta ..... A47C 1/03255
10,206,508 B2 * 2/2019 Desanta ..... A47C 7/445
10,258,820 B2 * 4/2019 Harlow ..... A63B 21/4039
10,272,282 B2 * 4/2019 Harlow ..... A47C 1/022
10,537,181 B2 * 1/2020 Brodbeck ..... A47C 1/024
2007/0108820 A1 * 5/2007 Ueda ..... A47C 7/445 297/300.5
2010/0301652 A1 * 12/2010 Ballendat ..... A47C 7/402 297/285 X

* cited by examiner

CHAIR

CROSS REFERENCE TO RELATED APPLICATIONS

This application is the National Phase filing under 35 U.S.C. § 371 of International Application No.: PCT/EP2018/052821, filed on Feb. 5, 2018, and published on Aug. 9, 2018 as WO 2018/141968 A1, which claims priority to German Application No.: 10 2017 102 148.5, filed on Feb. 3, 2017. The contents of each of these prior applications are hereby incorporated by reference herein in their entirety.

The invention relates to a chair, in particular an office chair, with a laterally pivotable backrest.

SUMMARY OF THE INVENTION

Figure 1:
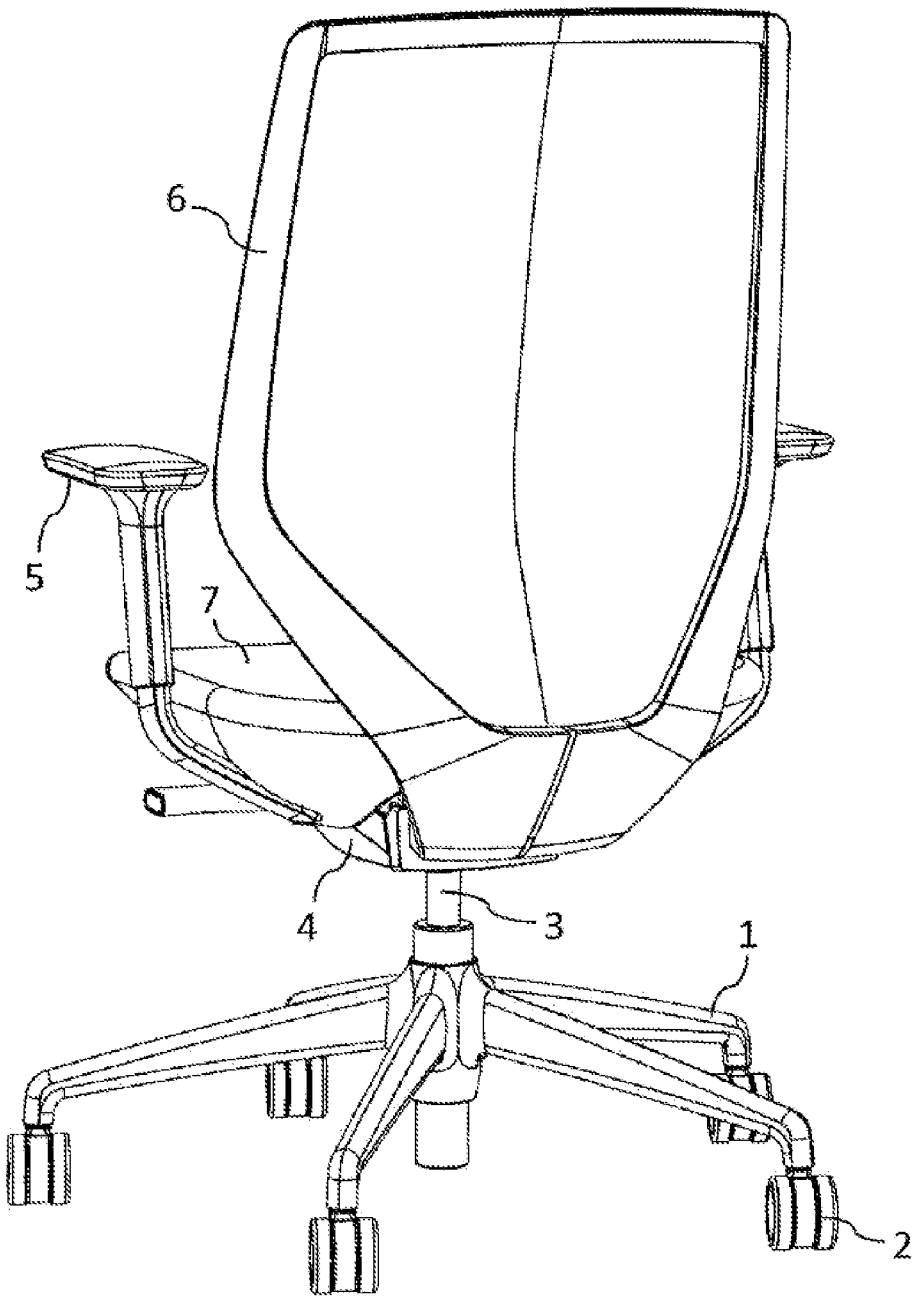
Figure 8:
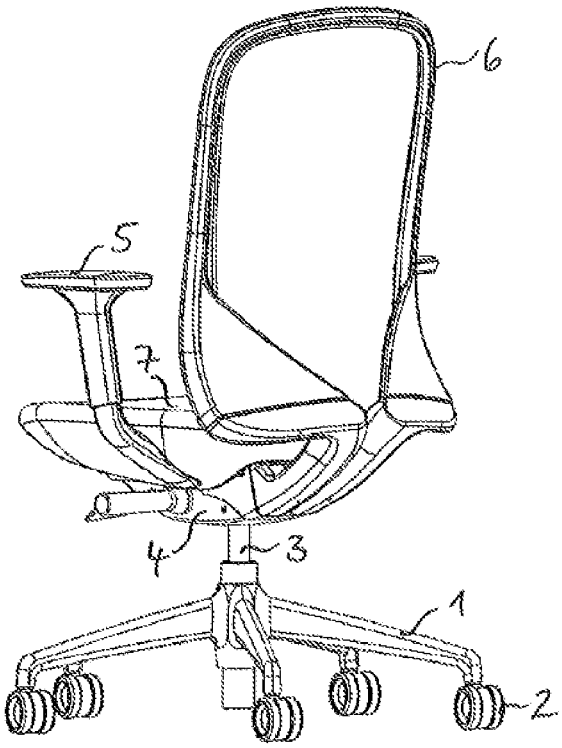
Figure 9:
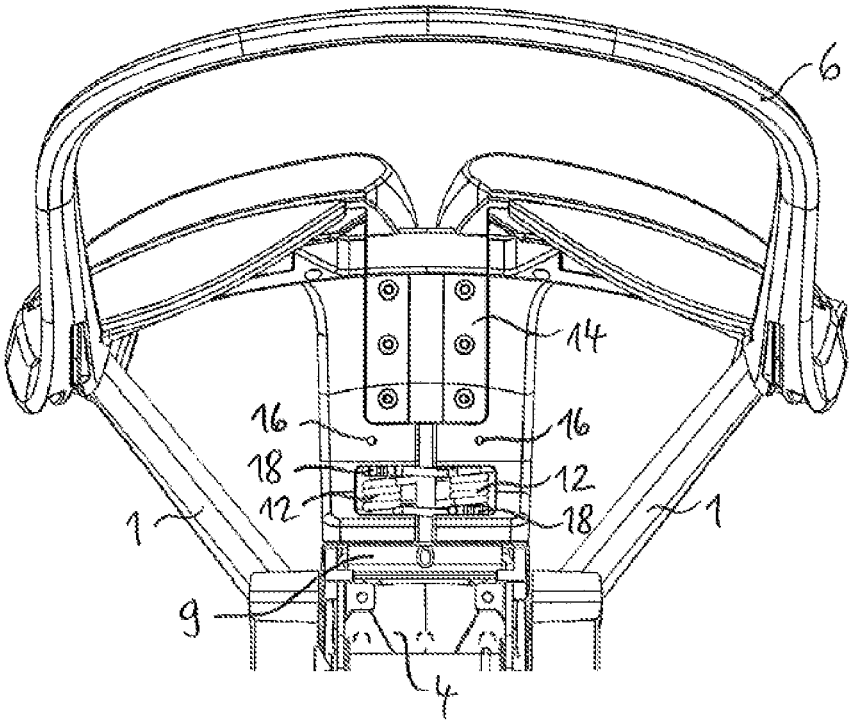
Figure 10:
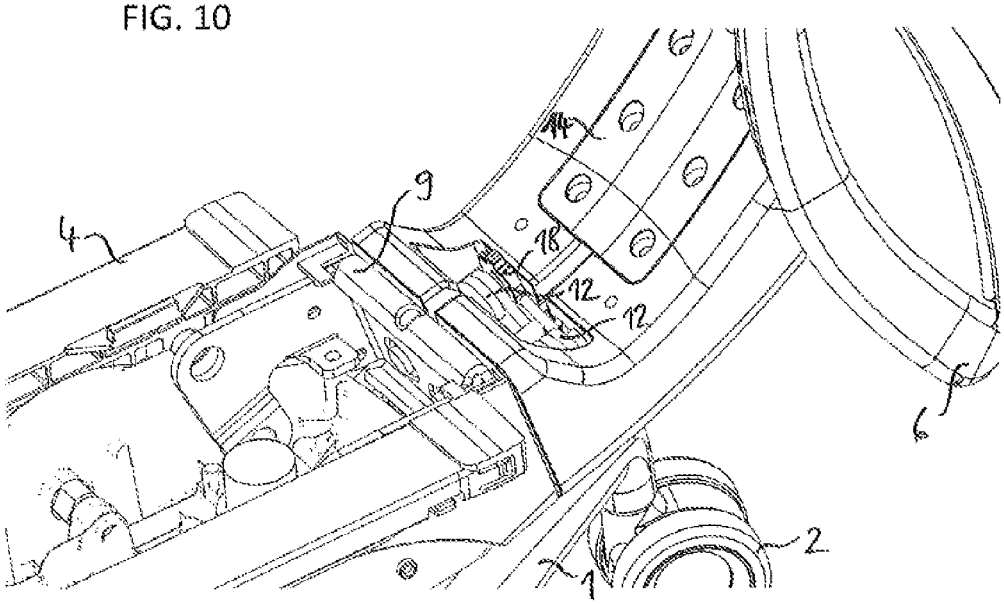
Figure 11:
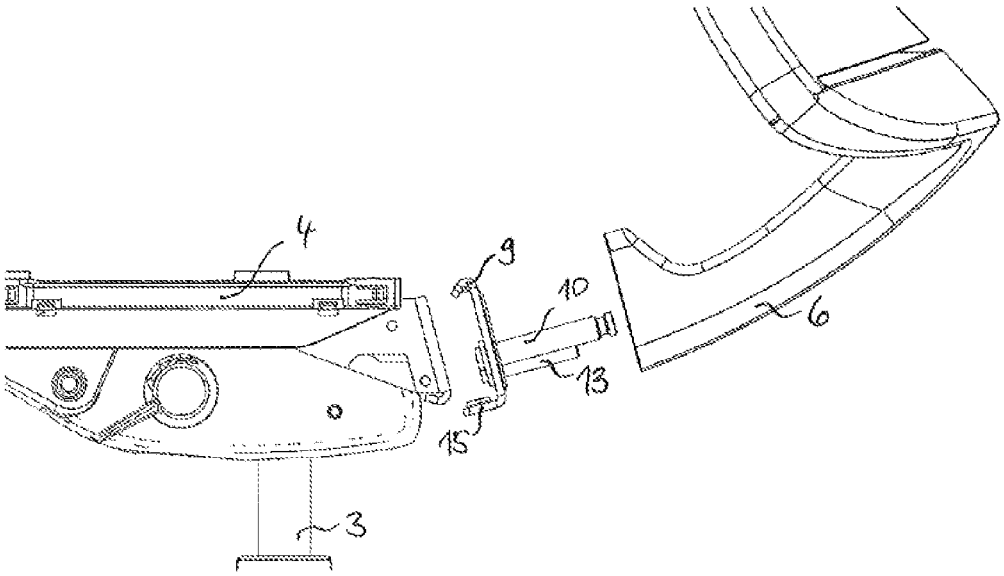
Figure 12:
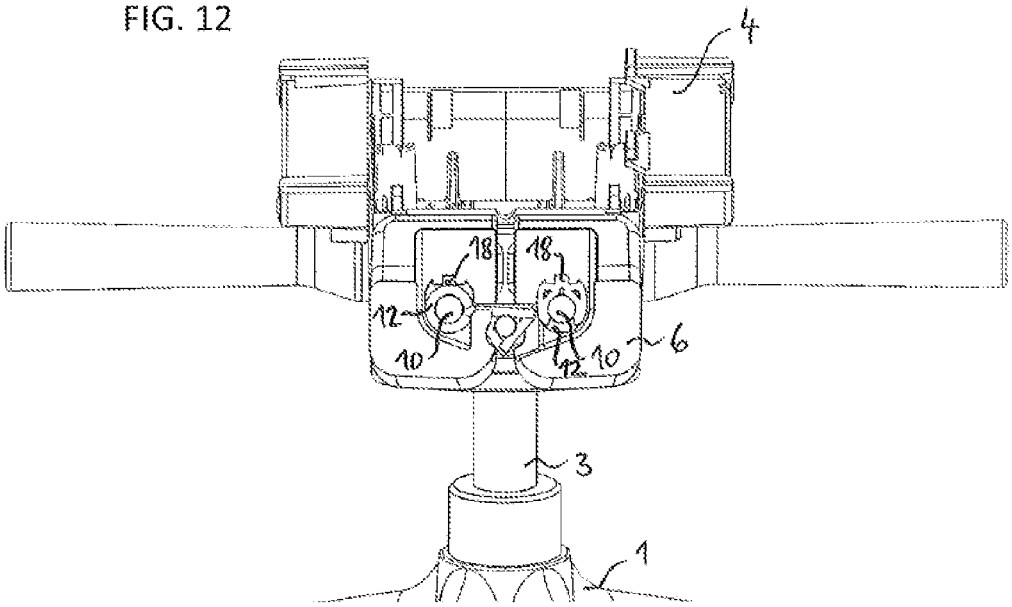
Figure 13:
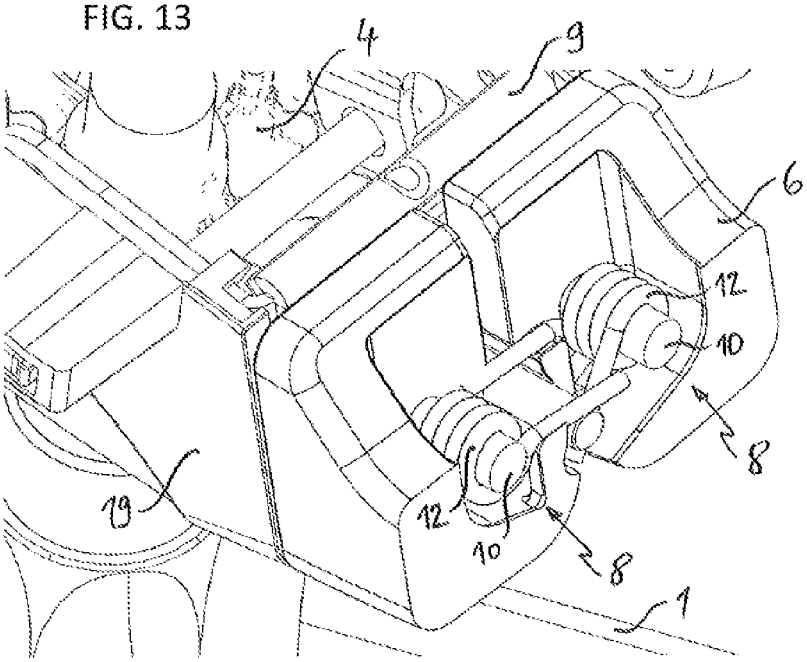
Figure 14:
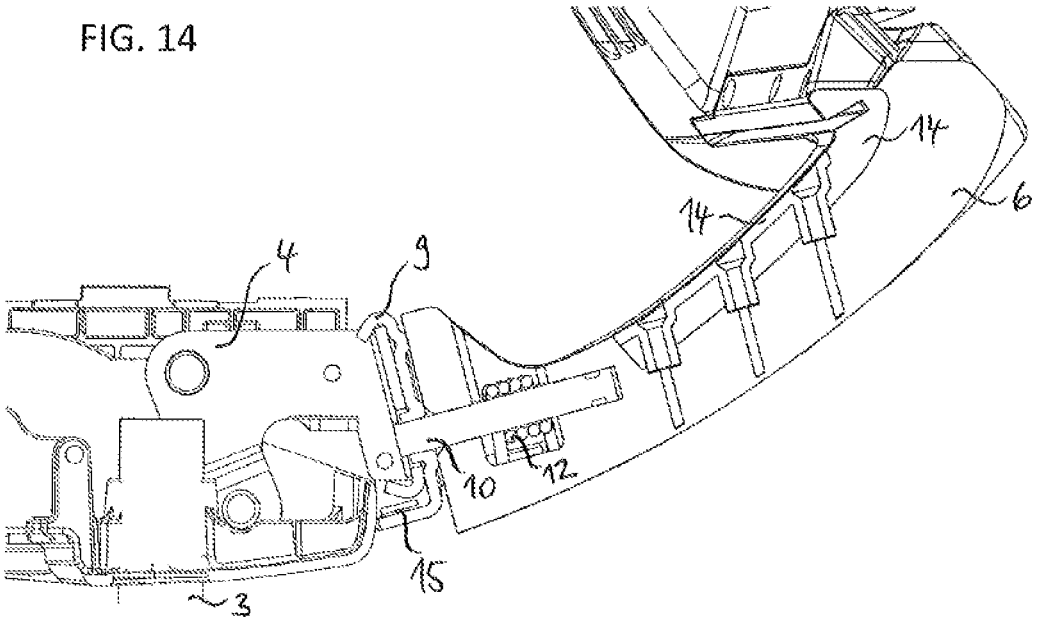
Figure 15:
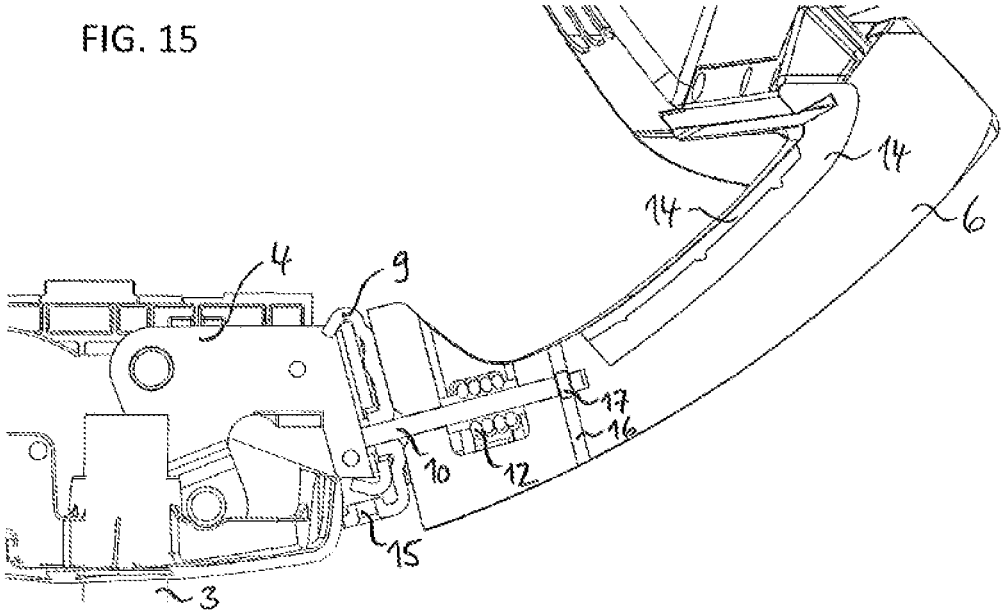

An office chair, as presented in FIGS. 1 and 8 by way of example, is a rotatable chair with a seat surface 7 and a backrest 6, which may also have armrests 5. The office chair rests on casters 2 which are secured to a so-called star base 1 which, in the example shown, has five arms. A gas pressure spring 3 which can be used to adjust the seat height of the office chair is positioned in the center of the star base 1. A chair mechanism 4, to which the backrest 6, the seat surface 7, and armrests 5 are secured, rests on the upper end of the gas pressure spring 3.

For ergonomic reasons, efforts have for many years focused on designing the components of an office chair to be as adjustable as possible, both absolutely and relative to one another, in order to allow the user the most dynamic possible sitting so that a maximum of physical movement can occur even while sitting. This stimulates the circulation and prevents bad posture.

The chair mechanism 4 may be designed as a so-called synchronous mechanism, for example, which couples the backrest 6 to the seat surface 7, wherein tilting of the backrest 6 causes typically slightly lesser tilting of the seat surface 7.

Office chairs on which the backrest 6 can not only be pivoted forward and back when a user leans on it but is also laterally pivotable, around a horizontal axis of rotation for example, which can be realized through a joint positioned behind the seat surface 7 are also known. Here, the backrest 6 is typically kept in the upright position or moved back to the upright position if the backrest 6 has been moved out of the upright position by a restoring element such as a spring or the like. Both the restoring element and the backrest 6 are therefore not under load in the upright position.

For further improvement of known office chairs, it is now proposed that the backrest 6 be secured to two joints 8 which have mutually parallel axes of rotation 10. In other words, the backrest 6 should thus be pivot-mounted on two mutually parallel axes of rotation 10. This results in a motion path for the backrest 6 which differs in comparison with known chairs with a laterally pivotable backrest. Furthermore, the backrest 6 can deform during the pivoting motion owing to the type of mounting selected, whereby a three-dimensional movement of the backrest 6 and generation of a restoring force can be achieved.

The axes of rotation 10 may for example be attached to a common base plate 9 and the base plate 9 for its part may be attached to a chair mechanism 4 which couples the backrest 6 with the seat surface 7, detachably for example. This would also allow for the use of commercial chair mechanisms 4, for which the attachment of the backrest 6 to two joints is not technically envisaged.

A first configuration may provide for the axes of rotation 10 with a horizontal plane to involve an acute angle $\alpha$. As a result, a lateral deflection to the left or right always also causes a slight forward or backward deflection of the backrest 6, which would not be the case for horizontally aligned axes of rotation 10, i.e. $\alpha=0$.

Alternatively or additionally, it may be provided for the joints 8 to each be operatively connected to a restoring element 12. Although the elastic deformation of the backrest 6, as explained above, already generates a restoring force which counteracts the lateral deflection of the backrest 6, it may be beneficial to assist or strengthen this restoring force through the use of the additional restoring elements 12 proposed here. Here, it may further be provided for the restoring elements 12 to act in opposite directions, i.e. one restoring element 12 counteracts a deflection to the left and the other restoring element counteracts a deflection to the right.

It may further be provided for the restoring elements 12 to be preloaded when the backrest 6 is in an upright position. As a result of this, the restoring force which counteracts a lateral deflection of the backrest 6 is strengthened.

In accordance with a further configuration, it is provided for the seat backrest 6 to have a frame which has a gap in the area between the joints 8. This gap means that the backrest 6 is able to more easily elastically deform during a lateral deflection and such a deformation generates an additional massage effect on the user's back. Such massage effects are very desirable because they counteract fatigue for the user and the development of back pain.

Here, it may further be provided for at least one elastic element 14 to be positioned in the gap. Although this elastic element allows for an elastic deformation as described above to a limited extent, it also strengthens the restoring force which counteracts a lateral deflection. In addition, the elastic element can serve to create an optical impression of an unbroken frame on the one hand and contribute to the securing of a fabric cover for the backrest 6, for example, on the other. Such an elastic element may for example be a two-component element made from different elastics, i.e. plastics with different degrees of malleability. Here, two material strips of a first plastic which is comparably hard and difficult to deform may enclose a material strip of a second, comparably soft and therefore easily malleable plastic. The two harder material strips may serve to secure the elastic element 14 to the frame of the backrest 6 on the left and right of the gap in this frame, for example by means of screws. The softer material strip located between them then serves to allow for deformation of the backrest 6, but also to counteract this deformation with a restoring force.

BRIEF DESCRIPTION OF THE DRAWING FIGURES

In the following, the invention is illustrated in more detail by way of two exemplary embodiments and associated drawings in which:

FIGS. 1 to 7 show various views and sectional views of the details of a first exemplary embodiment, and FIGS. 8 to 15 show various views and sectional views of the details of a second exemplary embodiment.

DETAILED DESCRIPTION

Figure 2:
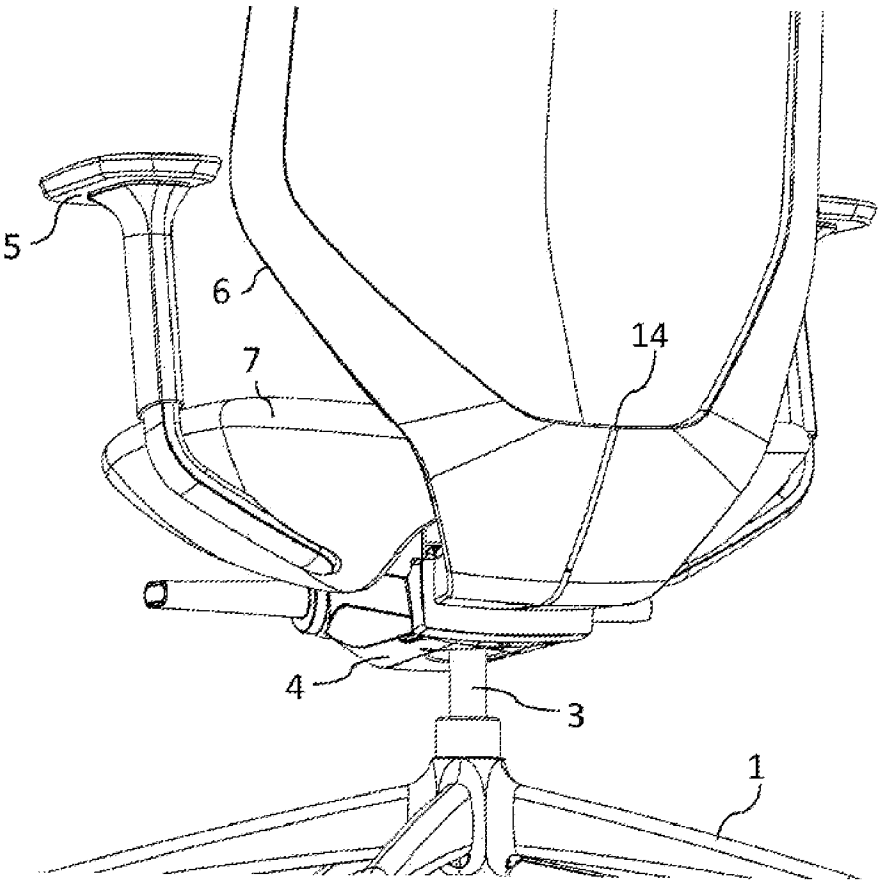

As can be seen from the representations in FIGS. 1 and 2, in the exemplary embodiment shown the seat backrest has a frame which has a gap in the area between the joints. At least one elastic element 14 may be positioned in this gap. In the example shown, the gap is filled by the elastic element 14. This may be a silicone rubber, polyurethane (PU) or similar rubber elastic material, for example. Alternatively, multiple elastic elements 14 which connect the opposite edges of the gap with one another may also be positioned in the gap. Through this, an interesting aesthetic effect can be achieved on the one hand, and on the other hand fine adjustment of the force effect of the elastic elements 14 on the two opposite edges of the gap can be achieved.

Figure 3:
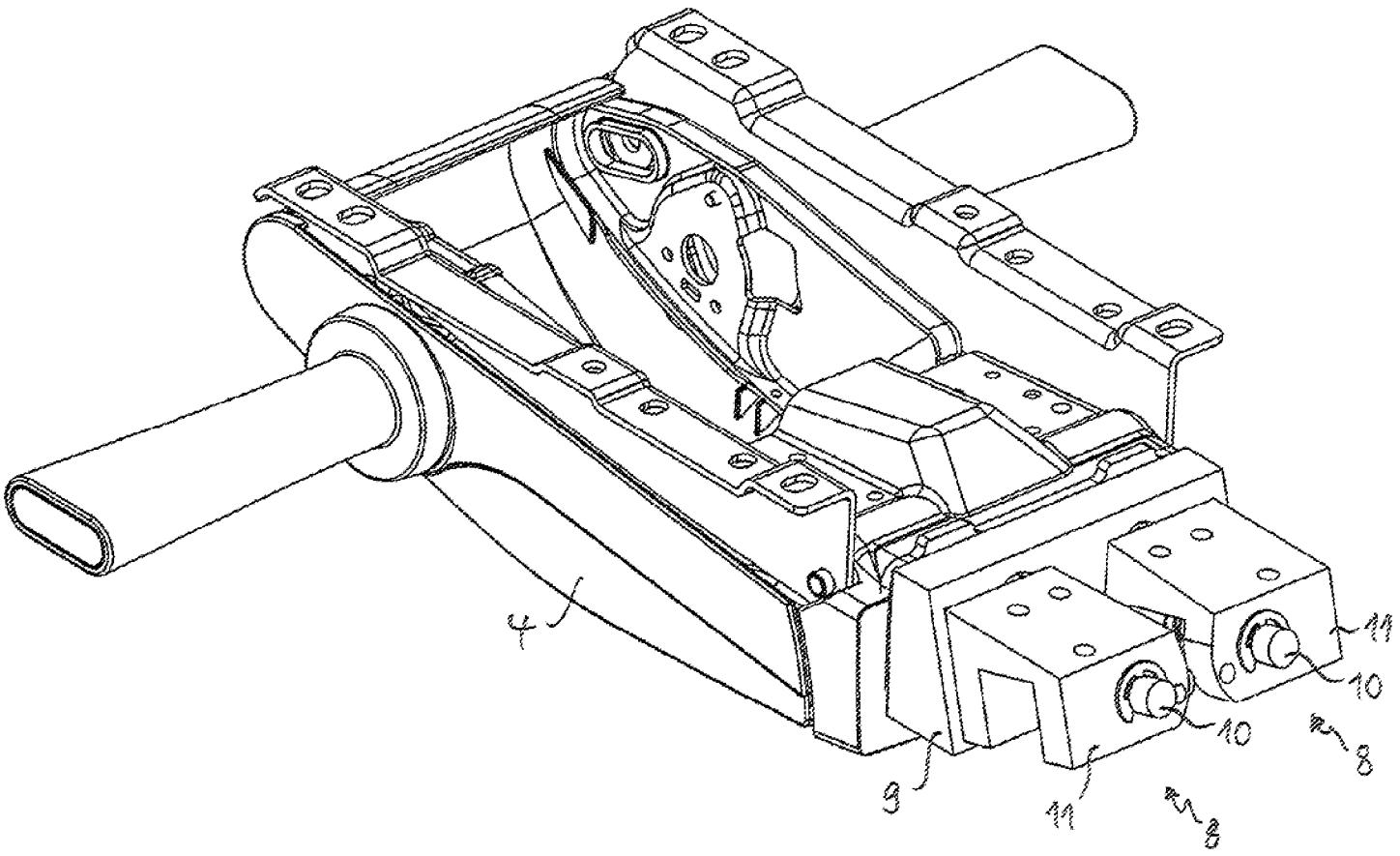
Figure 4:
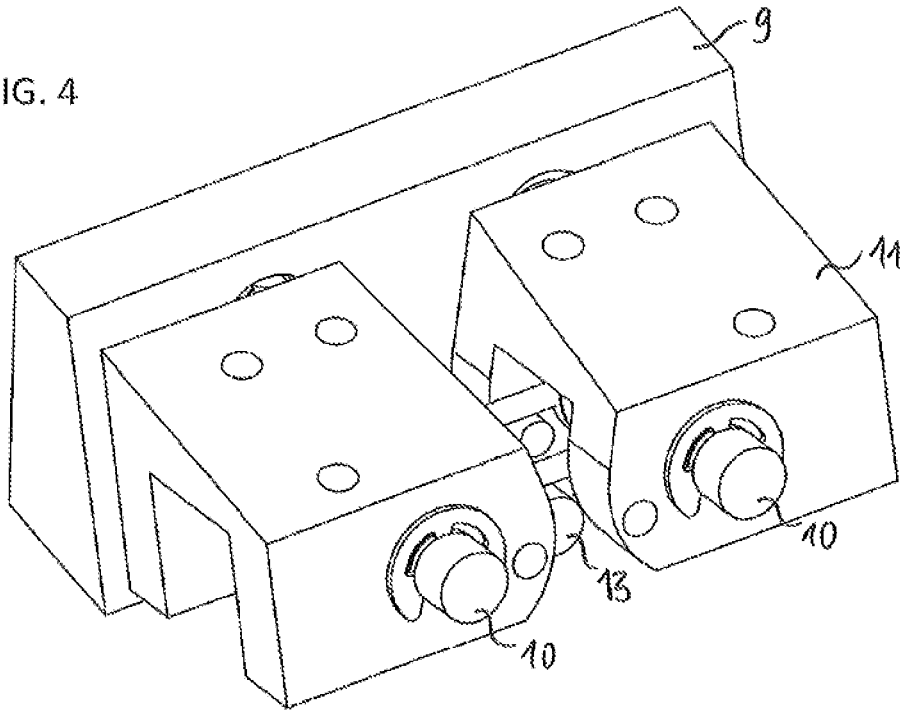
Figure 5:
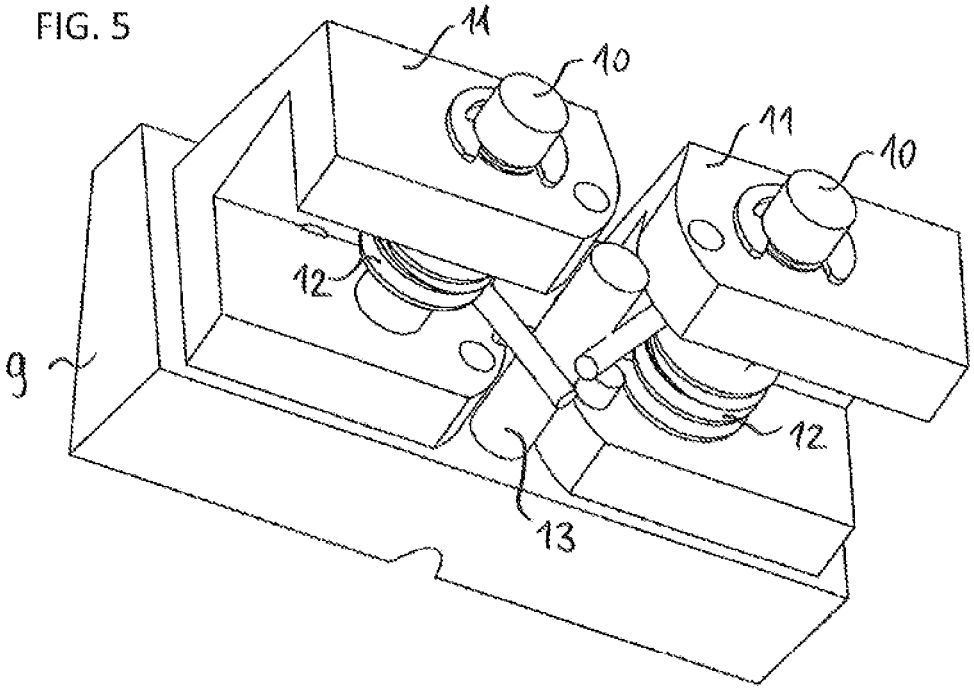

FIG. 3 shows a chair mechanism 4, on the rear end of which the joints 8 are positioned. FIGS. 4 and 5 show the joint arrangement released and from two different perspectives.

In this concrete exemplary embodiment, a base plate 9 to which the two axes of rotation 10 are secured on one side is attached to the rear end of the chair mechanism 4. A securing block 11 which is thus rotatable about the axis of rotation 10 sits on each axis of rotation 10. The two securing blocks 11 each have a recess on their underside, in each of which a restoring element 12 is positioned. The restoring elements 12 are realized as torsion springs which are each braced with a first limb on their securing block 11. Torsion springs, also known as rotational springs, are mechanical energy stores which absorb torque during an angular/rotational movement on the limb, which they release again when relaxed.

In the exemplary embodiment shown here, a stop element 13 on which the two restoring elements 12 are each braced with a second limb is positioned between the two axes of rotation 10. A rotation of a securing block 11 on the associated axis of rotation 10 then results in the associated restoring element 12 building a restoring force which is opposed to the rotation of the securing block 11. It can be seen from the representation that, in the example shown, the restoring elements 12 act in opposite directions. As a result, the backrest 6 is always held in an upright position in its unloaded state. The restoring elements 12 may be preloaded with the backrest in the upright position. The preloading may furthermore be adjustable.

It is to be understood that the joints 8 may also have a different design to that shown here in the exemplary embodiment. In particular, the concrete assembly of base plate 9, axes of rotation 10, securing blocks 11 and restoring elements 12 is by no means mandatory. For example, the moving part of a joint 8 may also be part of the backrest 6.

Figure 6:
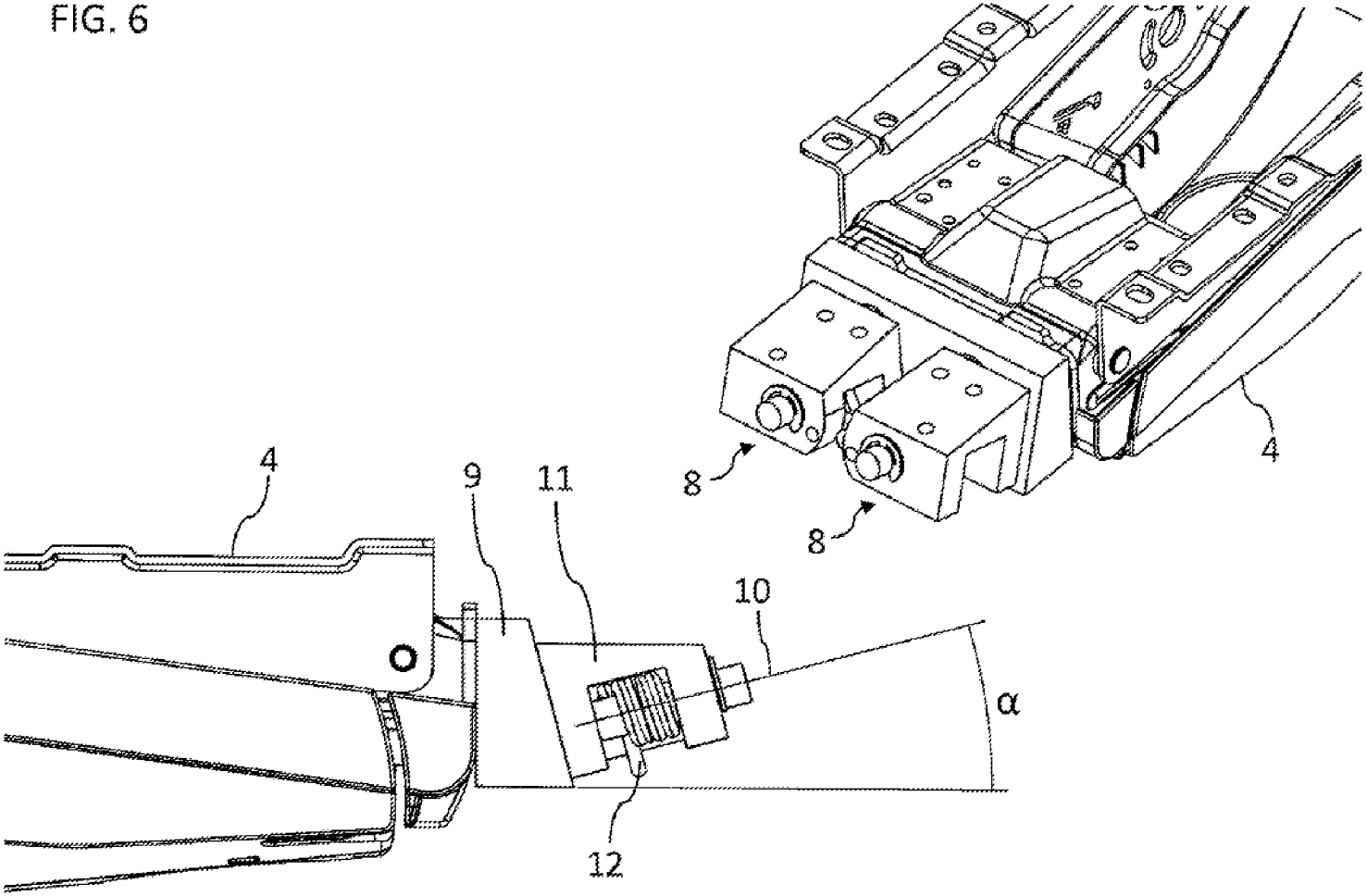

FIG. 6 shows a three-dimensional representation of the chair mechanism 4 with the joints 8 positioned thereon. As can be seen in particular from the side view presented below, the axes of rotation 10 of the joints 8 with a horizontal plane involve an acute angle $\alpha$.

Figure 7:
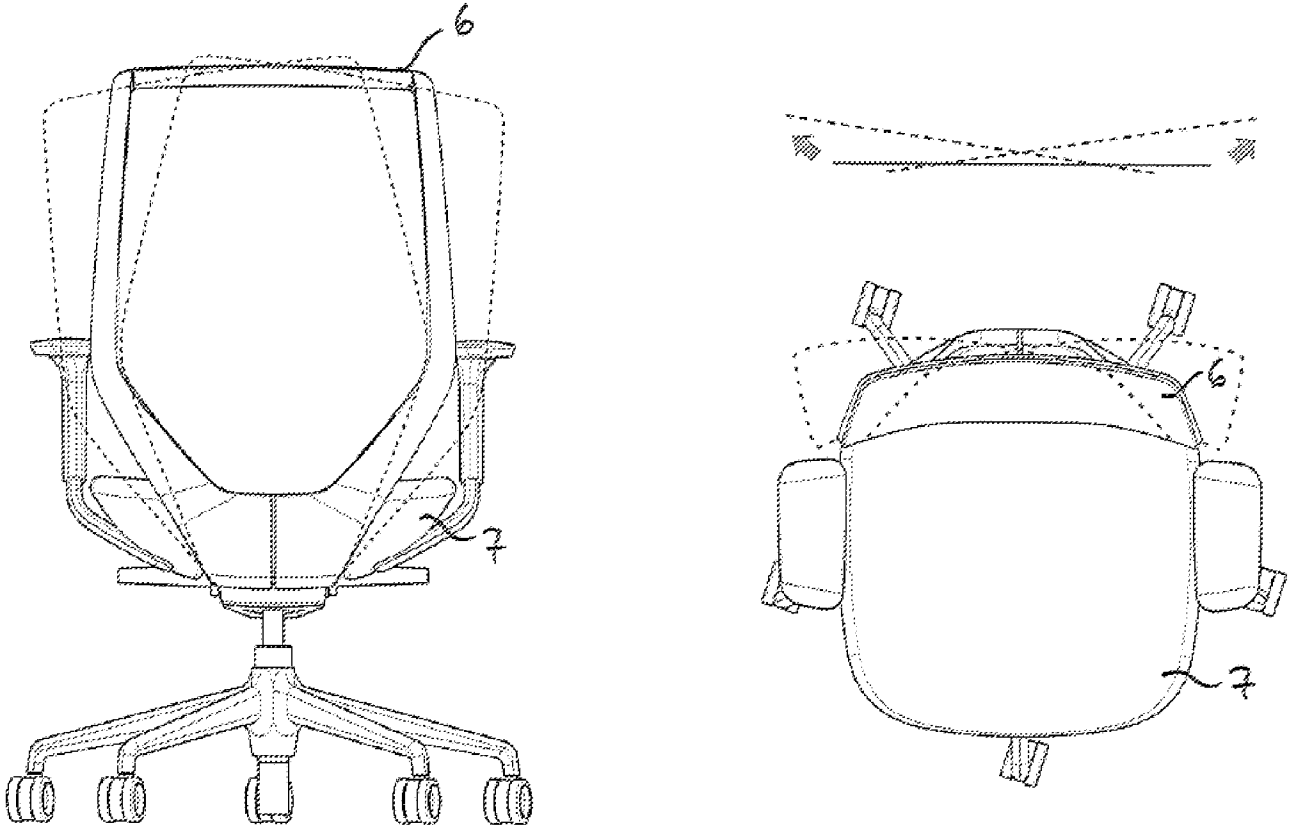

This results in a three-dimensional movement pattern of the backrest 6 vis-à-vis the seat surface 7, which is schematically shown in FIG. 7 in a rear view and in a top view.

The second exemplary embodiment presented in FIGS. 8 to 15 has many similarities and a few differences in comparison with the first exemplary embodiment.

In this case, the base plate 9 is a bent metal component, the upper edge of which is designed such that the base plate 9 can be suspended on the rear side of the chair mechanism 4. The connection between the base plate 9 and the chair mechanism 4 is secured by a retaining screw (not shown) which is attached to a threaded hole 15 which is provided on the underside of the base plate 9 for this purpose.

In this exemplary embodiment, the joints 8 do not have separate securing blocks which are rotatable around the axes of rotation 10. Instead, the axes of rotation 10 are directly connected to the bottom two spurs of the backrest 6. The bottom spurs of the backrest 6 have holes to this end into which the axes of rotation 10 are inserted. In order to secure the backrest 6 axially on the axes of rotation 10, securing pins 17 are positioned in holes 16 in the backrest 6 and the axes of rotation 10 which are aligned with one another.

In order to hold the restoring elements 12 in place in an axial direction of the axes of rotation 10, two spring securing clips 18 are positioned on the axes of rotation 10.

For aesthetic reasons, the adapter formed by the base plate 9, the axes of rotation 10 and the stop element 13 for attachment of the backrest 6 to the chair mechanism 4 is covered by the adapter cover 19 and is thus not visible from the outside.

Chair

LIST OF REFERENCE NUMERALS

1 Star base
2 Caster
3 Gas pressure spring
4 Chair mechanism
5 Armrest
6 Backrest
7 Seat surface
8 Joint
9 Base plate
10 Axis of rotation
11 Securing block
12 Restoring element
13 Stop element
14 Elastic element
15 Threaded hole
16 Hole
17 Securing pin
18 Spring securing clip
19 Adapter clip
$\alpha$ Angle

The invention claimed is:

1. A chair comprising a seat surface and a laterally pivotable backrest, wherein:

the backrest is secured to two joints, which have mutually parallel axes of rotation, the axes of rotation are attached on one side to a common base plate, extend backwards from the base plate at an acute angle (a) with a horizontal plane, the base plate is detachably attached to the rear end of a chair mechanism which couples the backrest to the seat surface, the joints are each operatively connected to restoring elements which are torsion springs which act in opposite directions, and wherein the seat backrest has a frame having a gap in an area between the joints.

2. The chair according to claim 1, wherein the restoring elements are preloaded with the backrest in an upright position.

3. The chair according to claim 2, wherein at least one elastic element is positioned in the gap.

4. The chair according to claim 3, wherein the elastic element is a two-component element made from different elastic plastics.

5. The chair according to claim 1, wherein at least one elastic element is positioned in the gap.

6. The chair according to claim 5, wherein the elastic element is a two-component element made from different elastic plastics.

7. The chair according to claim 1, wherein the torsion springs comprise:

a first torsion spring disposed over one of the mutually parallel axes of rotation, and a second torsion spring disposed over another of the mutually parallel axes of rotation.

8. The chair according to claim 7, comprising:

a stop element positioned between the mutually parallel axes of rotation, wherein a limb of each of the first and second torsion springs are braced against the stop element.

9. A chair comprising a seat surface and a laterally pivotable backrest, wherein:

the backrest is secured to two joints, which have mutually parallel axes of rotation, the axes of rotation are attached on one side to a common base plate, extend backwards from the base plate at an acute angle (a) with a horizontal plane, the base plate is detachably attached to the rear end of a chair mechanism which couples the backrest to the seat surface, the joints are each operatively connected to restoring elements which are torsion springs which act in opposite directions, wherein the seat backrest has a frame having a gap in an area between the joints, and wherein at least one elastic element is positioned in the gap.

10. The chair according to claim 9, wherein the at least one elastic element is a two-component element made from different elastic plastics.

11. The chair according to claim 9, wherein the restoring elements are preloaded with the backrest in an upright position.

* * * * *